US011706553B1

(12) United States Patent
Pan et al.

(10) Patent No.: US 11,706,553 B1
(45) Date of Patent: Jul. 18, 2023

(54) HEADPHONE DEVICE

(71) Applicant: PRIMAX ELECTRONICS LTD., Taipei (TW)

(72) Inventors: Yung-Tai Pan, Taipei (TW); Ting-Shuo Ku, Taipei (TW); Chun-Hsien Wu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/662,233

(22) Filed: May 6, 2022

(30) Foreign Application Priority Data

Mar. 29, 2022 (TW) ..... 111111965

(51) Int. Cl.
*H04R 1/10* (2006.01)

(52) U.S. Cl.
CPC ..... *H04R 1/1008* (2013.01); *H04R 1/1083* (2013.01); *H04R 1/1091* (2013.01); *H04R 2201/10* (2013.01); *H04R 2460/11* (2013.01)

(58) Field of Classification Search
CPC .. H04R 1/1008; H04R 1/1083; H04R 1/1091; H04R 2201/10; H04R 2460/11
See application file for complete search history.

(56) References Cited

U.S. PATENT DOCUMENTS

| | | | | |
|---|---|---|---|---|
| 5,357,585 | A * | 10/1994 | Kumar | H04R 1/1008 381/384 |
| 11,082,768 | B2 * | 8/2021 | Ong | H04R 1/2803 |
| 2007/0041605 | A1 * | 2/2007 | Yang | H04R 1/1016 381/370 |
| 2009/0232340 | A1 * | 9/2009 | Yang | H04R 1/2811 381/371 |
| 2017/0353780 | A1 * | 12/2017 | Huang | H04R 1/2849 |
| 2018/0192228 | A1 * | 7/2018 | Woelfl | H04S 7/304 |
| 2018/0295449 | A1 * | 10/2018 | Morgan | H04R 1/105 |
| 2018/0310090 | A1 * | 10/2018 | Wen | H04R 5/033 |
| 2020/0077171 | A1 * | 3/2020 | Chi-Hsueh | H04R 1/1008 |
| 2021/0058693 | A1 * | 2/2021 | Woelfl | H04R 1/1008 |
| 2022/0408171 | A1 * | 12/2022 | Hatfield | H04R 1/1075 |

* cited by examiner

*Primary Examiner* — Oyesola C Ojo
(74) *Attorney, Agent, or Firm* — WPAT, P.C

(57) ABSTRACT

A headphone device includes a covering member, a sound chamber casing and a speaker unit. The sound chamber casing is combined with the covering member, so that a sound chamber is formed. The speaker unit is installed within the sound chamber. The sound chamber includes a gas channel. The gas channel has a bend portion.

5 Claims, 10 Drawing Sheets

HEADPHONE DEVICE

FIELD OF THE INVENTION

The present invention relates to a headphone device, and more particularly to a headphone device worn on the user's head.

BACKGROUND OF THE INVENTION

Nowadays, earbuds, canalphones and headphones are widely used. The headphones have some advantageous when compared with the earbuds and the canalphones. For example, the headphones make it possible for the user to cover the entire ears. In addition, the headphones are comfortable to wear. Consequently, the headphones are suitably worn for a long time. For example, gaming headphones, monitoring headphones and music headphones are examples of the general headphones.

FIG. 1 schematically illustrates two conventional headphone devices. As shown in the situation (i) of FIG. 1, a speaker unit 20 of a headphone device 2 is installed in a closed-type sound chamber C2. For allowing the users who like heavy bass to hear more low-pitched sounds when using headphone devices, some headphone devices have holes in the sound chamber of the speaker unit. For example, in the situation (ii) of FIG. 1, a speaker unit 30 of a headphone device 3 is installed in a sound chamber C3. The sound chamber C3 has a through-type gas channel P3 that is in communication with the external environment. As a consequence, the ambient airflow can be introduced into the sound chamber C3 through the through-type gas channel P3, and the airflow exchange is performed. Due to the airflow exchange, the stroke of the diaphragm of the speaker unit 30 can be increased. Consequently, the speaker unit 30 can generate more low-frequency response, and the user can obtain more low-frequency sound pressure from the headphone device 3.

Although the arrangement of the through-type gas channel P3 in the sound chamber C3 is helpful for the introduction and exchange of ambient airflow, there are still some drawbacks. For example, the sound or noise in the external environment may enter the headphone device 3 along the gas channel P3. Consequently, when the user listens to the sound effect with heavy bass, the sound effect is affected and interfered by more ambient noises. In other words, the good listening experience cannot be obtained.

In order to overcome the drawbacks of the conventional technologies, it is important to provide a headphone device having the functions of providing a low frequency response effect and effectively blocking the ambient noise.

SUMMARY OF THE INVENTION

The present invention provides a headphone device with a low frequency response effect. In addition, the headphone device has a good passive noise reduction function.

In accordance with an aspect of the present invention, a headphone device is provided. The headphone device includes a covering member, a sound chamber casing and a speaker unit. The covering member includes plural sound outlet holes. The sound chamber casing is combined with an inner surface of the covering member, so that a sound chamber is formed. The sound chamber casing includes a base, a lateral wall, an arc-shaped pedestal, a first vent and an arc-shaped cover plate. The lateral wall is circumferentially formed on the base. The arc-shaped pedestal is located at a junction between the base and the lateral wall. The arc-shaped pedestal includes a recess. A first end of the recess is located above the lateral wall. A second end of the recess is opposed to the first end and located above the base. There is at least one bend portion between the first end and the second end of the recess. The first vent is formed in a bottom side of the recess and located near the first end of the recess. After the arc-shaped cover plate is combined with the arc-shaped pedestal and the recess is sealed, a gas channel is formed at a position corresponding to the recess, and a second vent is formed at a position corresponding to the second end of the recess. The speaker unit is installed within the sound chamber. The speaker unit includes a sound transmitter terminal. The sound transmitter terminal faces the plural sound outlet holes.

In an embodiment, an outer surface of the covering member includes a concave structure and a convex structure. The convex structure is located at a middle region of the concave structure. The sound outlet holes are formed in the convex structure.

In an embodiment, an accommodation space is formed in the inner surface of the covering member. The accommodation space is aligned with the convex structure. The speaker unit is disposed within the accommodation space.

In an embodiment, the headphone device further includes an outer shell. The outer shell covers the sound chamber casing and is combined with the covering member. The outer shell has an opening corresponding to the first vent.

In an embodiment, two protrusion edge structures in a stepped form are respectively located beside two lateral sides of the recess. The protrusion edge structures are located at a level higher than the bottom side of the recess. The arc-shaped cover plate is tightly contacted with the protrusion edge structures. Consequently, the first end of the recess is sealed.

From the above descriptions, the present invention provides the headphone device. The sound chamber casing of the headphone device includes the gas channel. The gas channel is in communication with the sound chamber. As a consequence, the ambient airflow can be introduced into the sound chamber through the gas channel, and the airflow exchange is performed. Due to the airflow exchange, the oscillation amount of the diaphragm of the speaker unit increases. In this way, the sound transmitter terminal of the speaker unit generates more low-frequency sound pressure. Moreover, when the ambient sound or noise passes through the bend portion of the gas channel, a portion of the sound or noise is absorbed by the bend portion, and intensity of the sound or noise is gradually attenuated. Since the ambient noise is effectively blocked, the user can get a good listening experience.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2:
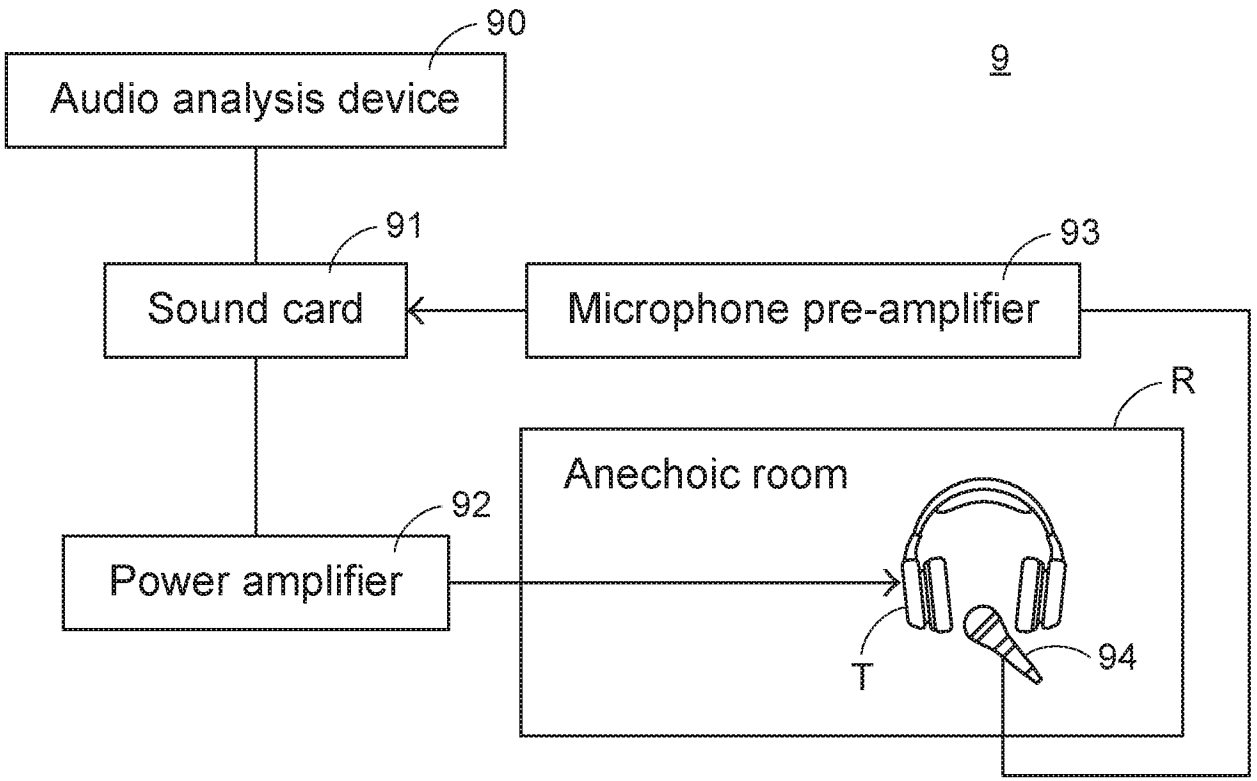
FIG. 2 schematically illustrates a headphone frequency response measurement system.
Figure 3:
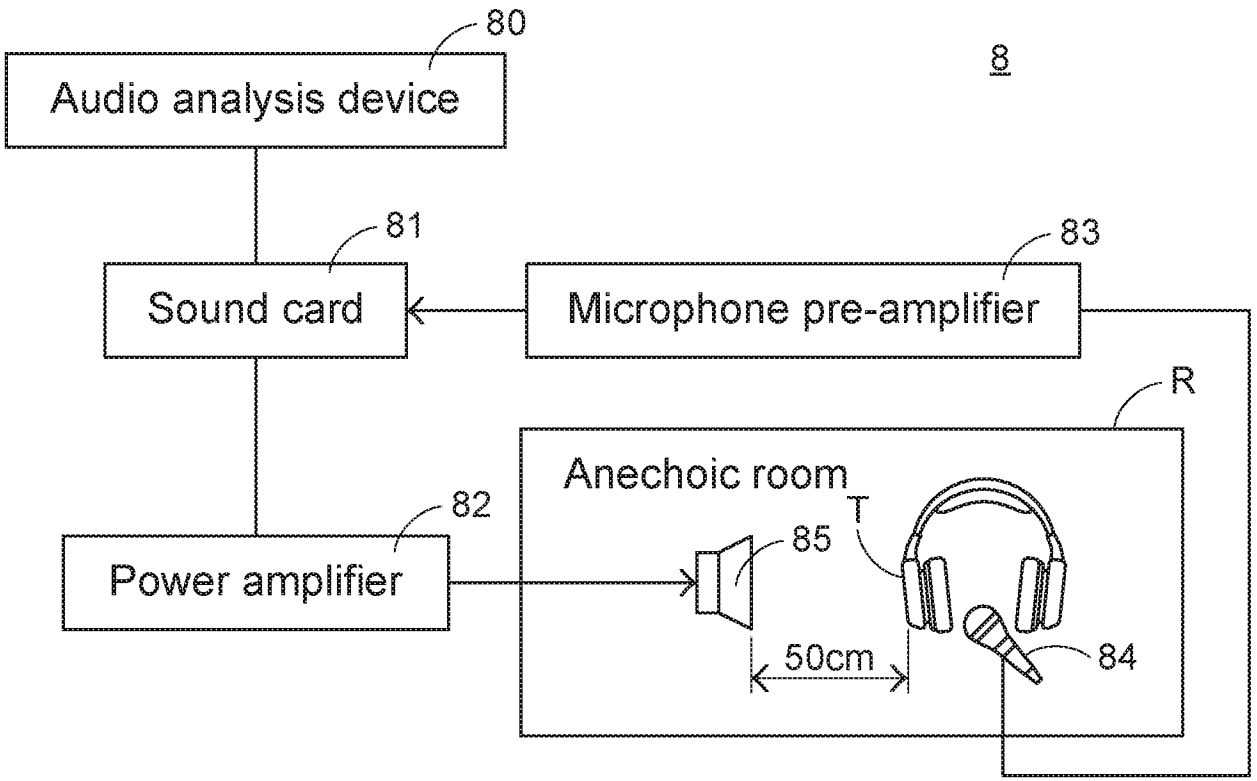
FIG. 3 schematically illustrates a headphone passive sound insulation and noise reduction measurement system.

Please refer to FIGS. 2 and 3. FIG. 2 schematically illustrates a headphone frequency response measurement system. FIG. 3 schematically illustrates a headphone passive sound insulation and noise reduction measurement system.

As shown in FIG. 2, the headphone frequency response measurement system 9 comprises an audio analysis device 90, a sound card 91, a power amplifier 92, a microphone pre-amplifier 93, a HATS microphone 94, an under-test headphone device T and an anechoic room R.

The audio analysis device 90 is electrically connected with the sound card 91. The sound card 91 is electrically connected with the power amplifier 92 and the microphone pre-amplifier 93. The power amplifier 92 is also electrically connected with the under-test headphone device T. The microphone pre-amplifier 93 is also electrically connected with the HATS microphone 94.

The under-test headphone device T and the HATS microphone 94 are both disposed within the anechoic room R. The HATS microphone 94 is located in front of the sound transmitter terminal of the under-test headphone device T. The anechoic room R is used to isolate the interference of ambient noise in order to improve the detection accuracy of the headphone frequency response measurement system 9.

A process of performing the frequency response measurement will be described as follows. Firstly, the audio analysis device 90 generates a test signal through the sound card 91 and transmits the test signal to the power amplifier 92. After the power amplifier 92 receives the test signal, the power amplifier 92 drives the under-test headphone device T to generate a detection sound wave. Then, the HATS microphone 94 receives the detection sound wave from the under-test headphone device T. In addition, the detection sound wave is transmitted back to the audio analysis device 90 through the microphone pre-amplifier 93 so as to be analyzed by the audio analysis device 90.

As shown in FIG. 3, the headphone passive sound insulation and noise reduction measurement system 8 comprises an audio analysis device 80, a sound card 81, a power amplifier 82, a microphone pre-amplifier 83, a HATS microphone 84, an under-test speaker unit 85, an under-test headphone device T and an anechoic room R.

The audio analysis device 80 is electrically connected with the sound card 81. The sound card 81 is electrically connected with the power amplifier 82 and the microphone pre-amplifier 83. The power amplifier 82 is also electrically connected with the under-test speaker unit 85. The microphone pre-amplifier 83 is also electrically connected with the HATS microphone 84.

The HATS microphone 84, the under-test speaker unit 85 and the under-test headphone device T are all disposed within the anechoic room R. The distance between the under-test speaker unit 85 and the under-test headphone device T is about 50 centimeters. The HATS microphone 84 is located in front of the sound transmitter terminal of the under-test headphone device T. The anechoic room R is used to isolate the interference of ambient noise in order to improve the detection accuracy of the headphone passive sound insulation and noise reduction measurement system 8.

A process of performing the passive sound insulation and noise reduction measurement will be described as follows. Firstly, the audio analysis device 80 generates a test signal through the sound card 81 and transmits the test signal to the power amplifier 82. After the power amplifier 82 receives the test signal, the power amplifier 82 drives the under-test speaker unit 85 to emit a detection sound wave to the under-test headphone device T. The detection sound wave is used to simulate the sound or noise in the external environment. Then, the detection sound wave is transmitted through the under-test headphone device T. Then, the HATS microphone 84 receives the detection sound wave from the under-test headphone device T. In addition, the detection sound wave is transmitted back to the audio analysis device 80 through the microphone pre-amplifier 83 so as to be analyzed by the audio analysis device 80.

Figure 4:
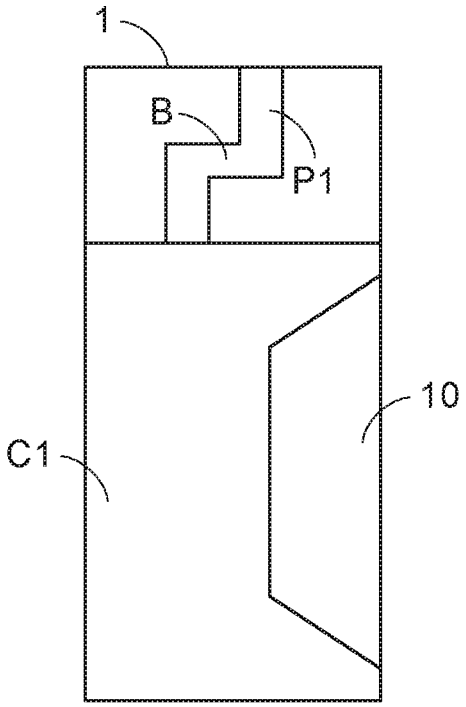
FIG. 4 schematically illustrates a headphone device according to an embodiment of the present invention.

FIG. 4 schematically illustrates a headphone device according to an embodiment of the present invention. As shown in FIG. 4, a speaker unit 10 of a headphone device 1 is installed in a sound chamber C 1. The sound chamber C1 has a through-type gas channel P1 that is in communication with the external environment. Especially, the through-type gas channel P1 has a bending portion B.

Figure 1:
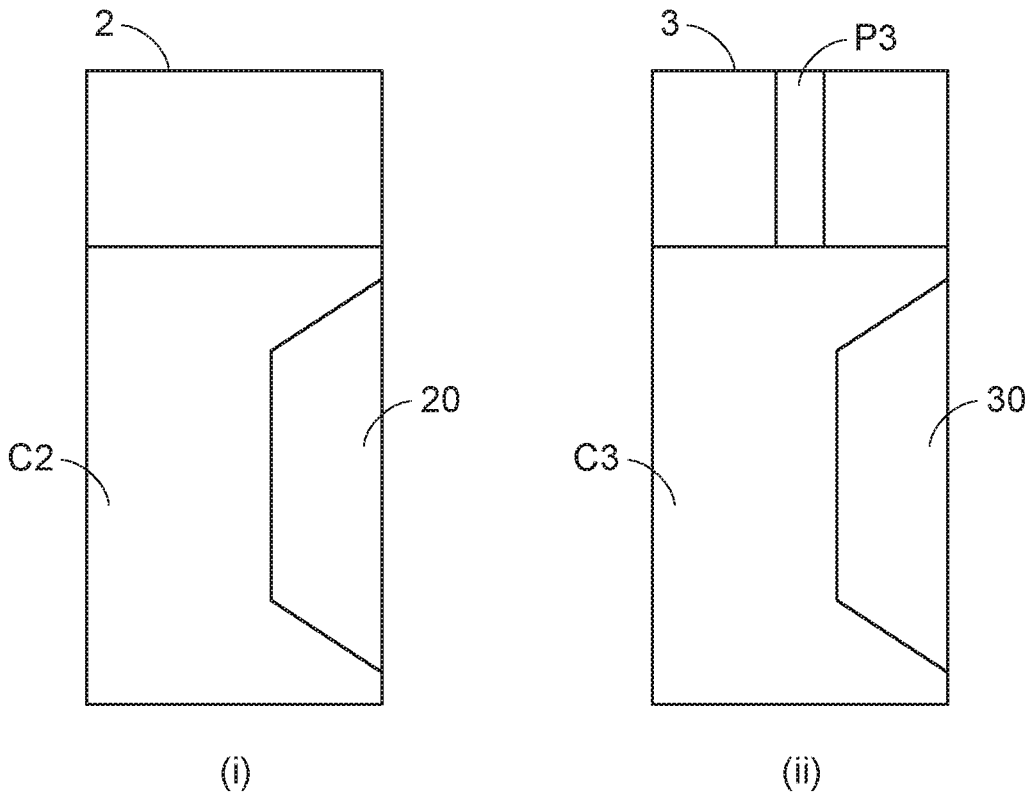
FIG.1 PRIOR ART
FIG. 1 schematically illustrates two conventional headphone devices.
Figure 5A:
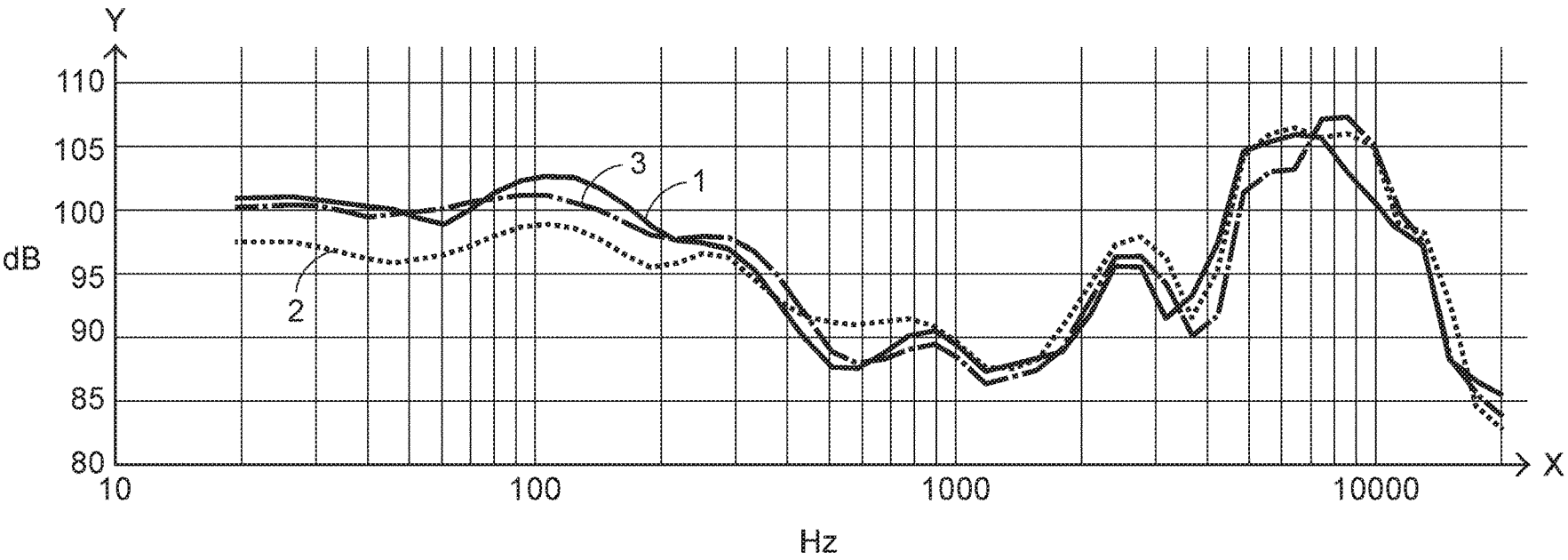
FIG. 5A is a frequency response diagram illustrating the measurement results of the present headphone device and the conventional microphone test devices.

FIG. 5A is a frequency response diagram illustrating the measurement results of the present headphone device and the conventional microphone test devices. During the process of the frequency response measurement, the present headphone device 1 as shown in FIG. 4 and the headphone device 2 and the headphone device 3 as shown in FIG. 1 are sequentially placed at the position of the under-test headphone device T as shown in FIG. 2. In addition, the headphone devices 1, 2 and 3 are electrically connected with the power amplifier 92. Consequently, the power amplifier 92 can drive the headphone devices 1, 2 and 3 to generate the corresponding detection sound waves.

In FIG. 5A, the X axis denotes the sound frequencies (unit: Hz) of the detection sound waves received from the speaker units 10, 20 and 30 of the headphone devices 1, 2 and 3 by the HATS microphone 94, and the Y axis denotes the sound intensities (unit: dB) of the detection sound waves received from the speaker units 10, 20 and 30 of the headphone devices 1, 2 and 3 by the HATS microphone 94. From the curves of FIG. 5A, it is clearly found that the performance of the sound intensity of the headphone device 1 (and the headphone device 3) in the low frequency range from 20 Hz to 200 Hz is better than that of the headphone device 2 with the closed-type sound chamber C2. Moreover, the sound intensity of the headphone device 1 is better than or similar to that of headphone device 3.

As mentioned above, the headphone device 3 has the through-type gas channel P3. In comparison with the headphone device 3, the through-type gas channel P1 of the headphone device 1 has the bend portion B. The ambient airflow also can be introduced into the sound chamber C1 through the through-type gas channel P1 effectively. Consequently, the oscillation amount of the vibration diaphragm of the speaker unit 10 increases. In this way, the sound transmitter terminal of the speaker unit 10 generates more low-frequency sound pressure.

Figure 5B:
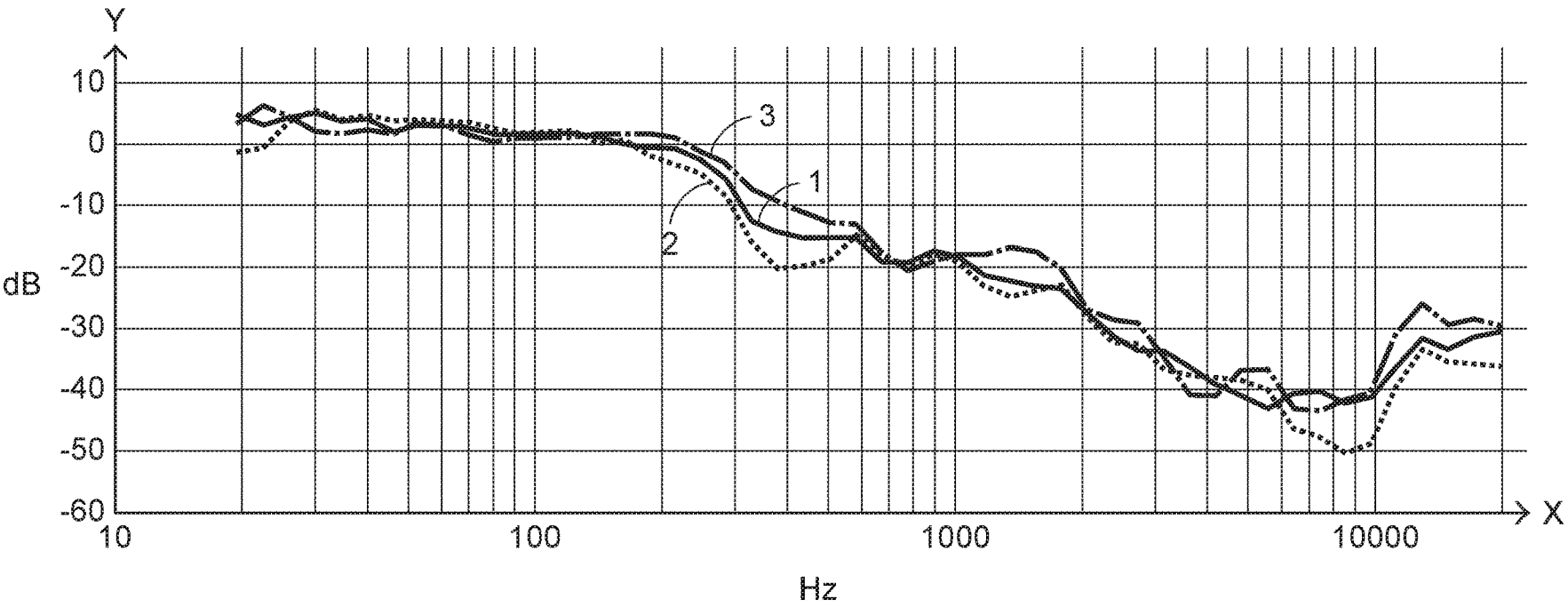
FIG. 5B is a passive sound insulation and noise attenuation diagram illustrating the measurement results of the present headphone device and the conventional microphone test devices.

FIG. 5B is a passive sound insulation and noise attenuation diagram illustrating the measurement results of the present headphone device and the conventional microphone test devices. During the process of the passive sound insulation and noise attenuation, the present headphone device 1 as shown in FIG. 4 and the headphone device 2 and the headphone device 3 as shown in FIG. 1 are sequentially placed at the position of the under-test headphone device T as shown in FIG. 3. Moreover, the power amplifier 82 drives the under-test speaker unit 85 to sequentially emit detection sound waves to the headphone devices 1, 2 and 3. The detection sound waves are used to simulate the sound or noise in the external environment.

In FIG. 5B, the X axis denotes the sound frequencies (unit: Hz) of the detection sound waves received from the headphone devices 1, 2 and 3 by the HATS microphone 84, and the Y axis denotes the sound intensities (unit: dB) of the detection sound waves received from the headphone devices 1, 2 and 3 by the HATS microphone 84. The results of the passive noise reduction of the headphone devices 1, 2 and 3 can be seen from the curves of FIG. 5B. It is found that the attenuation level of the sound intensity of the detection sound wave passing through the headphone device 1 (having the through-type gas channel P1 with the bending portion B) in frequency band from the low frequency 100 Hz to the high frequency 2000 Hz is obviously larger than that of the headphone device 3 (having the through-type gas channel P3). Moreover, the noise reduction performance of the headphone device 1 is similar to the headphone device 2 (having the close-type sound chamber C2 and having no gas channel).

From the experimental data of the frequency response measurement curve (FIG. 5A) and the passive sound insulation and noise attenuation curve (FIG. 5B), it is found that the performance of the sound intensity of the speaker unit of the headphone device 1 (having the through-type gas channel P1 with the bending portion B) in the low frequency band is similar to that of the headphone device 3 (having the through-type gas channel P3). However, the passive noise reduction effect of the headphone device 1 is obviously better than that of the headphone device 3.

Figure 6A:
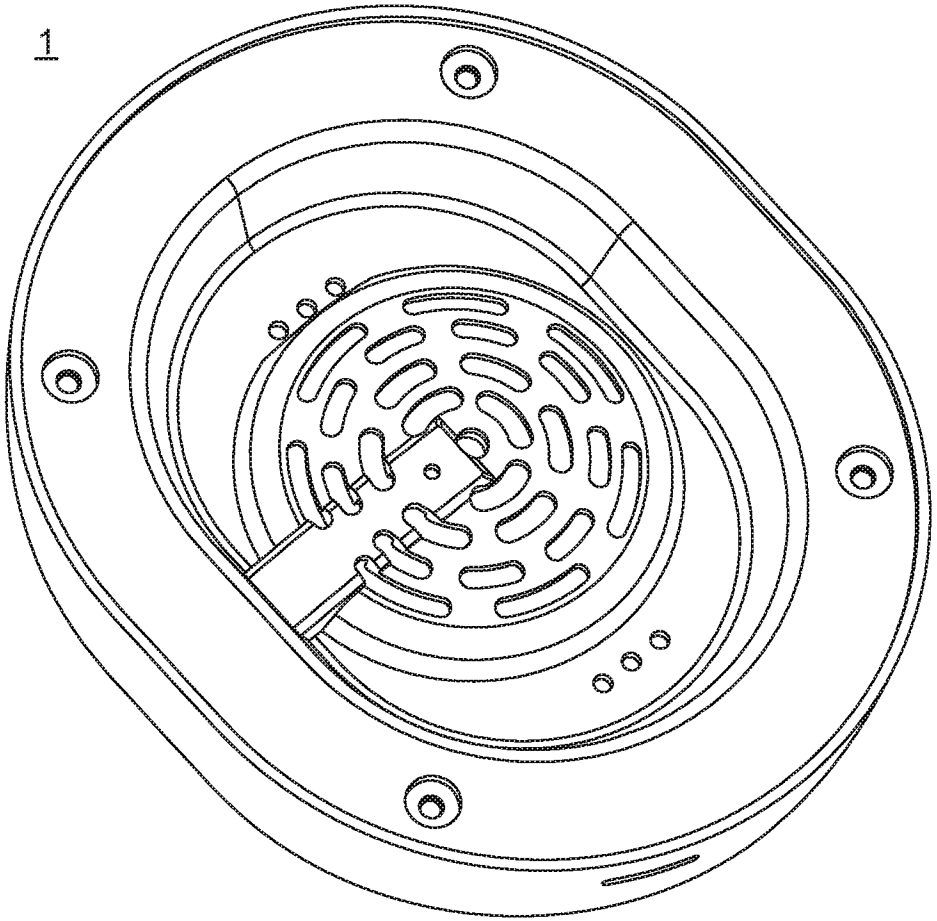
FIG. 6A is a schematic perspective view illustrating the structure of the headphone device according to the embodiment of the present invention.
Figure 6B:
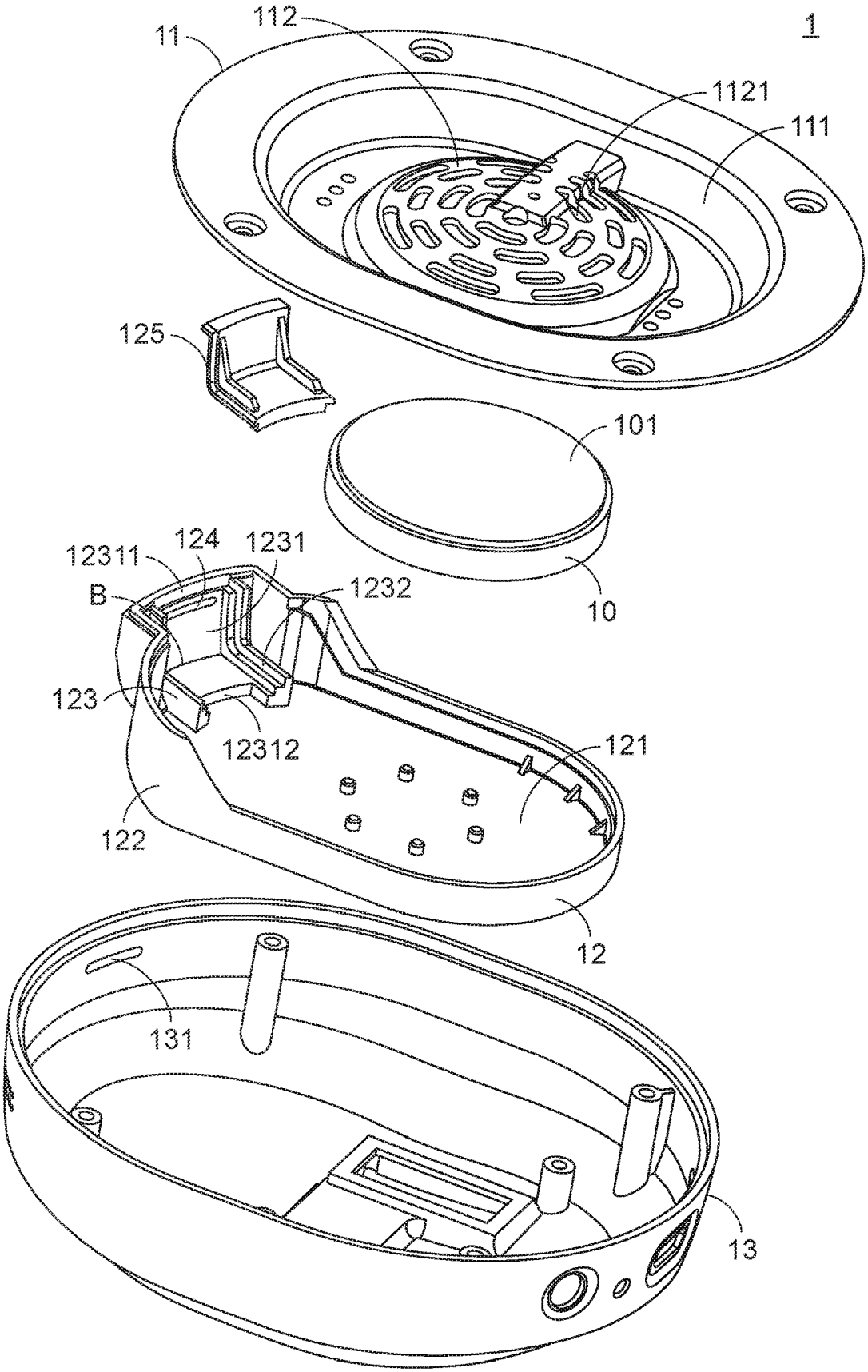
FIG. 6B is a schematic exploded view illustrating the headphone device as shown in FIG. 6A and taken along a viewpoint.
Figure 6C:
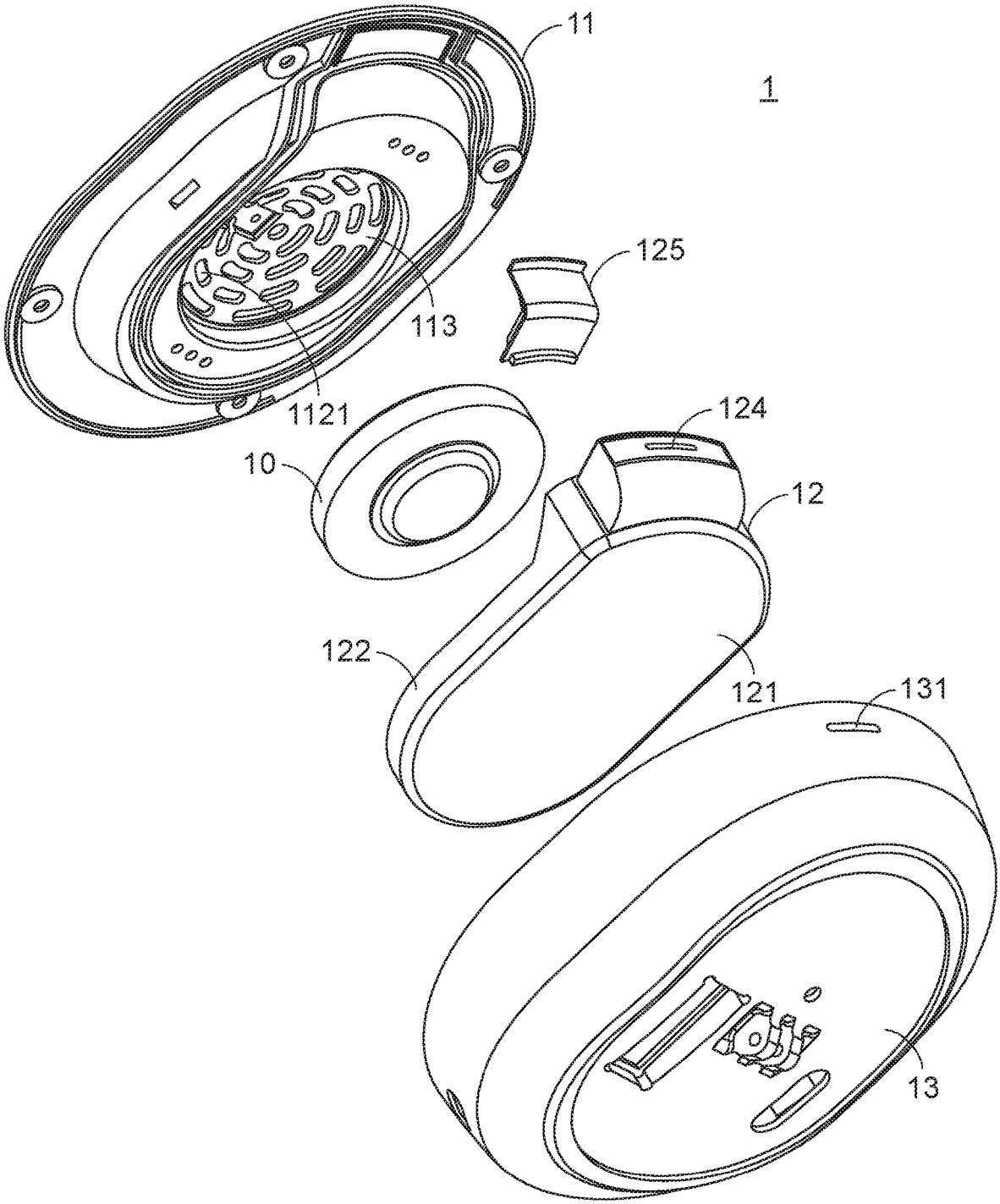
FIG. 6C is a schematic exploded view illustrating the headphone device as shown in FIG. 6A and taken along another viewpoint.

Please refer to FIGS. 6A, 6B and 6C. FIG. 6A is a schematic perspective view illustrating the structure of the headphone device according to the embodiment of the present invention. FIG. 6B is a schematic exploded view illustrating the headphone device as shown in FIG. 6A and taken along a viewpoint. FIG. 6C is a schematic exploded view illustrating the headphone device as shown in FIG. 6A and taken along another viewpoint.

In this embodiment, the headphone device 1 comprises a speaker unit 10, a covering member 11, a sound chamber casing 12 and an outer shell 13.

The speaker unit 10 comprises a sound transmitter terminal 101. The outer surface of the covering member 11 has a concave structure 111 and a convex structure 112. The concave structure 111 has a bowl-shaped cross section. The convex structure 112 is located at a middle region of the concave structure 111. The convex structure 112 comprises plural sound outlet holes 1121. The sound outlet holes 1121 run through the convex structure 112. An earmuff or a cushion structure (not shown) can be disposed within the concave structure 111.

As shown in FIG. 6C, an accommodation space 113 is formed in an inner surface of the covering member 11. The installation position of the accommodation space 113 is aligned with the installation position of the convex structure 112 on the outer surface of the covering member 11. Consequently, the sound outlet holes 1121 are exposed to the bottom surface of the accommodation space 113. The speaker unit 10 is disposed within the accommodation space 113. In addition, the sound transmitter terminal 101 of the speaker unit 10 faces the sound outlet holes 1121 in the bottom surface of the accommodation space 113. Consequently, the sound wave generated by the sound transmitter terminal 101 can be outputted to the external environment through the sound outlet holes 1121.

The sound chamber casing 12 comprises a base 121, a lateral wall 122, an arc-shaped pedestal 123, a first vent 124 and an arc-shaped cover plate 125. The lateral wall 122 is circumferentially formed on the base 121. The arc-shaped pedestal 123 is located at the junction between the base 121 and the lateral wall 122. The arc-shaped pedestal 123 comprises a recess 1231. The recess 1231 has a first end 12311 and a second end 12312, which are opposed to each other. Moreover, there is a bend portion B between the first end 12311 and the second end 12312 of the recess 1231. In this embodiment, the first end 12311 is located above the lateral wall 122, and the second end 12312 is located above the base 121. Moreover, two protrusion edge structures 1232 in a stepped form are respectively located beside two lateral sides of the recess 1231. The protrusion edge structures 1232 are located at a level higher than the bottom side of the recess 1231.

The first vent 124 runs through the bottom side of the recess 1231 and located near the first end 12311 of the recess 1231. The arc-shaped cover plate 125 is combined with the arc-shaped pedestal 123. Consequently, the recess 1231 is sealed. When the arc-shaped cover plate 125 is installed on the arc-shaped pedestal 123, the lateral edges of the arc-shaped cover plate 125 are tightly contacted with the protrusion edge structures 1232 of the arc-shaped pedestal 123, and the first end 12311 of the recess 1231 is sealed.

The sound chamber casing 12 is covered by the outer shell 13. Moreover, the outer shell 13 is combined with the covering member 11. The outer shell 13 has an opening 131 corresponding to the first vent 124 of the sound chamber casing 12. Moreover, the outer shell 13 is further connected with a bracket (not shown) of the headphone device.

Figure 7:
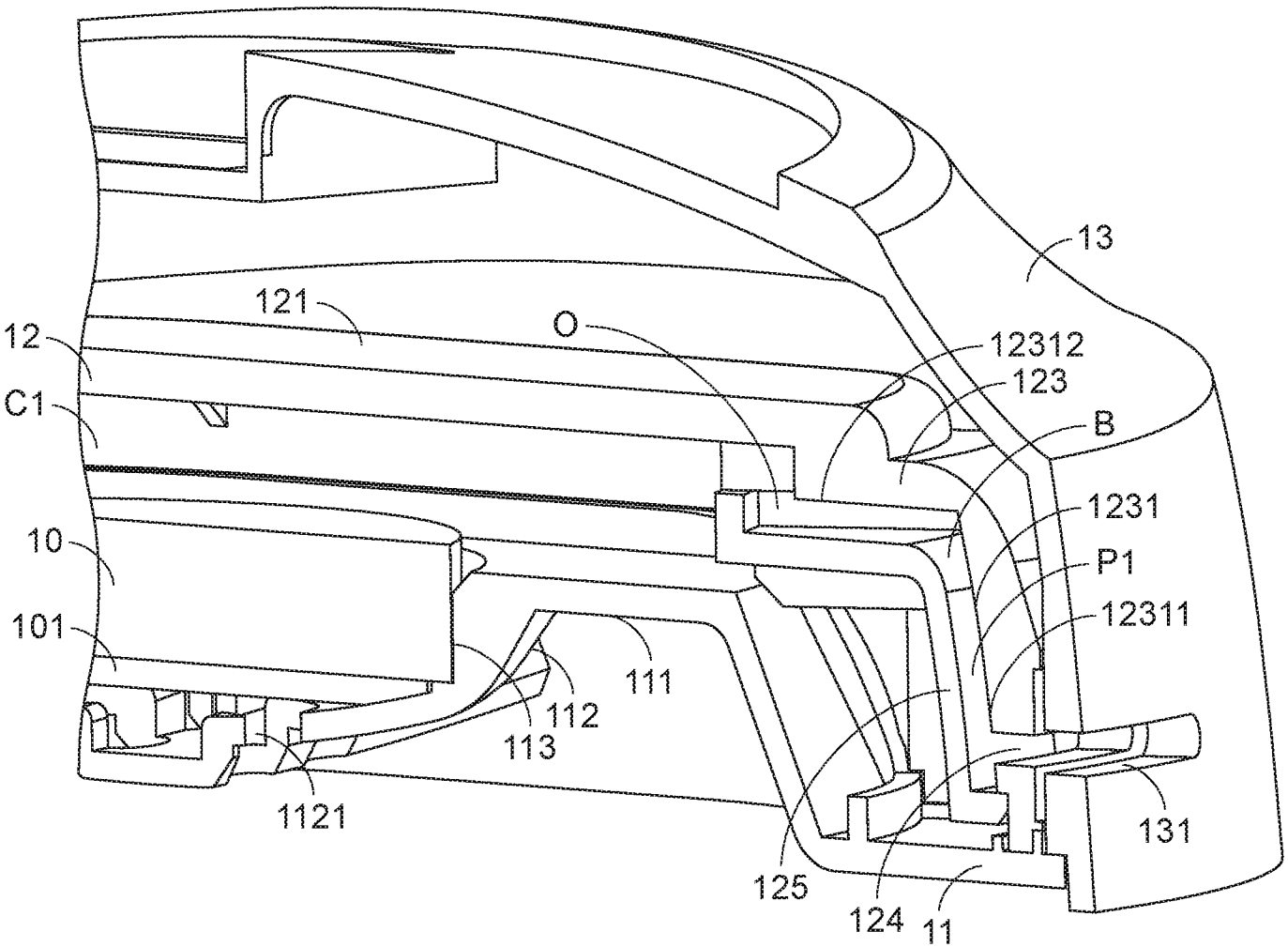
FIG. 7 is a schematic cutaway view illustrating a portion of the headphone device according to the embodiment of the present invention.

Please refer to FIG. 7. FIG. 7 is a schematic cutaway view illustrating a portion of the headphone device according to the embodiment of the present invention. After the sound chamber casing 12 is combined with the inner surface of the covering member 11, the sound chamber Cl is formed. After the lateral edges of the arc-shaped cover plate 125 are tightly contacted with the protrusion edge structures 1232 of the arc-shaped pedestal 123 and the first end 12311 of the recess 1231 is sealed, a gas channel P1 with the bending portion B is formed at the position corresponding to the recess 1231. Moreover, since the arc-shaped cover plate 125 is not tightly contacted with the second end 12312 of the recess 1231 of the arc-shaped pedestal 123, a second vent O of the gas channel P1 is formed at the position corresponding to the second end 12312 of the recess 1231.

Please refer to FIG. 7 again. When the outer shell 13 is combined with the covering member 11, the opening 131 is aligned with the first vent 124. The ambient airflow can be introduced into the sound chamber Cl through the opening 131, the first vent 124, the gas channel P1 and the second vent O. Consequently, the oscillation amount of the vibration diaphragm of the speaker unit 10 increases. In this way, the sound transmitter terminal 101 of the speaker unit 10 generates more low-frequency sound pressure. Moreover, when the ambient sound or noise passes through the gas channel P1, the bend portion B can absorb a portion of the sound or noise. Consequently, the intensity of the sound or noise is gradually attenuated, and the ambient noise is effectively blocked.

From the above descriptions, the present invention provides the headphone device. The sound chamber casing of the headphone device includes the gas channel. The gas channel is in communication with the sound chamber. As a consequence, the ambient airflow can be introduced into the sound chamber through the gas channel, and the airflow exchange is performed. Due to the airflow exchange, the oscillation amount of the diaphragm of the speaker unit increases. In this way, the sound transmitter terminal of the speaker unit generates more low-frequency sound pressure. Moreover, when the ambient sound or noise passes through the bend portion of the gas channel, a portion of the sound or noise is absorbed by the bend portion, and intensity of the sound or noise is gradually attenuated. Since the ambient noise is effectively blocked, the user can get a good listening experience. In other words, the headphone device of the present invention is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A headphone device, comprising:

a covering member comprising plural sound outlet holes;

a sound chamber casing, wherein the sound chamber casing is combined with an inner surface of the covering member, so that a sound chamber is formed, wherein the sound chamber casing comprises a base, a lateral wall, an arc-shaped pedestal, a first vent and an arc-shaped cover plate, wherein the lateral wall is circumferentially formed on the base, the arc-shaped pedestal is located at a junction between the base and the lateral wall, the arc-shaped pedestal comprises a recess, a first end of the recess is located above the lateral wall, a second end of the recess is opposed to the first end and located above the base, and there is at least one bend portion between the first end and the second end of the recess, wherein the first vent is formed in a bottom side of the recess and located near the first end of the recess, wherein after the arc-shaped cover plate is combined with the arc-shaped pedestal and the recess is sealed, a gas channel is formed at a position corresponding to the recess, and a second vent is formed at a position corresponding to the second end of the recess; and a speaker unit installed within the sound chamber, wherein the speaker unit comprises a sound transmitter terminal, and the sound transmitter terminal faces the plural sound outlet holes.

2. The headphone device according to claim 1, wherein an outer surface of the covering member comprises a concave structure and a convex structure, wherein the convex structure is located at a middle region of the concave structure, and the sound outlet holes are formed in the convex structure.

3. The headphone device according to claim 2, wherein an accommodation space is formed in the inner surface of the covering member, wherein the accommodation space is aligned with the convex structure, and the speaker unit is disposed within the accommodation space.

4. The headphone device according to claim 1, wherein the headphone device further comprises an outer shell, wherein the outer shell covers the sound chamber casing and is combined with the covering member, wherein the outer shell has an opening corresponding to the first vent.

5. The headphone device according to claim 1, wherein two protrusion edge structures in a stepped form are respectively located beside two lateral sides of the recess, and the protrusion edge structures are located at a level higher than the bottom side of the recess, wherein the arc-shaped cover plate is tightly contacted with the protrusion edge structures, so that the first end of the recess is sealed.

* * * * *